US006418696B1

(12) United States Patent
Swingle

(10) Patent No.: US 6,418,696 B1
(45) Date of Patent: Jul. 16, 2002

(54) APPARATUS FOR ARCHITECTURAL UNIT CONSTRUCTION

(76) Inventor: Marvin Leroy Swingle, 1301 Highvue Dr., Knoxville, TN (US) 37932

( * ) Notice: Subject to any disclaimer, the term of this patent is extended or adjusted under 35 U.S.C. 154(b) by 0 days.

(21) Appl. No.: 09/590,217

(22) Filed: Jun. 8, 2000

Related U.S. Application Data

(60) Division of application No. 09/186,857, filed on Nov. 5, 1998, now Pat. No. 6,155,021, which is a continuation-in-part of application No. 08/653,406, filed on May 24, 1996, now Pat. No. 5,870,878.

(51) Int. Cl.[7] ..... E04G 21/14

(52) U.S. Cl. ..... 52/749.1; 52/745.08; 269/10; 269/40; 269/42; 269/46

(58) Field of Search ..... 52/745.03, 749.1, 52/749.11; 269/9, 10, 34, 37, 40, 41, 42, 46

(56) References Cited

U.S. PATENT DOCUMENTS

| | | | | |
|---|---|---|---|---|
| 2,392,734 A | | 1/1946 | Haberstump | |
| 2,776,683 A | | 1/1957 | Cowley | |
| 3,044,129 A | | 7/1962 | Bigelow | |
| 3,222,837 A | | 12/1965 | Daley | |
| 3,394,389 A | | 7/1968 | Amir | |
| 3,556,508 A | | 1/1971 | Varga | |
| 4,049,368 A | | 9/1977 | Grachten | |
| 4,102,374 A | * | 7/1978 | Klein | 144/314 |
| 4,157,819 A | | 6/1979 | Meyer | |
| 4,228,912 A | | 10/1980 | Harris et al. | |
| 4,315,390 A | | 2/1982 | Schaafsma | |
| 4,577,854 A | * | 3/1986 | Bachmann et al. | 271/227 |
| 4,718,960 A | | 1/1988 | Pasqualini | |
| 4,743,004 A | | 5/1988 | Kloss | |
| 5,001,877 A | | 3/1991 | Edwards | |
| 5,135,206 A | | 8/1992 | Martinez | |
| 5,179,811 A | | 1/1993 | Walker et al. | |
| 5,330,262 A | | 7/1994 | Peters | |
| 5,419,264 A | | 5/1995 | Davis | |
| 5,463,835 A | | 11/1995 | Wood | |
| 5,549,862 A | * | 8/1996 | Vail | 264/238 |
| 5,581,957 A | | 12/1996 | Egger, Jr. et al. | |
| 5,733,022 A | | 3/1998 | Whetstone | |
| 5,870,878 A | * | 2/1999 | Swingle | 52/277 |
| 6,155,021 A | * | 12/2000 | Swingle | 52/745.08 |
| 6,220,677 B1 | * | 4/2001 | Ancel | 312/140.4 |

* cited by examiner

*Primary Examiner*—Carl D. Friedman
*Assistant Examiner*—Yvonne M. Horton
(74) *Attorney, Agent, or Firm*—Ludeka, Neely & Graham, P.C.

(57) ABSTRACT

Architectural units having radiused wall corners are constructed with solid surfacing material (SSM) such as Corian. Cove moldings are formed from SSM sheet strips comprising an elongated cove form flanked by elongated rabbet channels. In a table jig, an SSM wall sheet edge is adhesively secured into one of the cove molding rabbet channels. The cove mold and wall sheet unit is secured to the desired architectural wall with the other cove molding rabbet channel mated to an SSM wall sheet edge respective to an adjacent architectural wall. Clamping blocks secured to respective wall sheet and cove mold surfaces by hot melt adhesive are drawn together along the correct vector to adhesively bond each wall sheet edge into a respective rabbet channel.

4 Claims, 12 Drawing Sheets

APPARATUS FOR ARCHITECTURAL UNIT CONSTRUCTION

CROSS-REFERENCE TO RELATED APPLICATION

This application is a divisional of application Ser. No. 09/186,857 filed Nov. 5, 1998, now U.S. Pat. No. 6,155,021, which is a continuation-in-part of application Ser. No. 08/653,406 filed May 24, 1996, now U.S. Pat. No. 5,870, 878.

BACKGROUND OF THE INVENTION

The present invention relates to the fabrication of cabinets and architectural enclosures from solid surfacing material.

The term "solid surfacing material" is used by the architectural and habitation construction arts to describe non-foamed, non-laminated polymer-based materials useful for defining and constructing architectural surfaces and elements. These polymer-based solid surfacing materials are typically manufactured substantially of polyester or acrylic resins, alloys and mixtures thereof. Often, natural and/or mineral additives are combined to achieve a desired color or visual pattern in the composite along with fabrication workability and natural feel.

Use of solid surfacing materials began as kitchen and bath countertops due to a combination of mechanical and aesthetic properties including moisture imperviousness, durability, workability, ease of repair, ease of cleaning, ease of sterilization and beauty. Since introduction, use of solid surfacing material has spread to countless other applications such as shower enclosure walls and dressing areas.

Although a few cast or heat formed specialty shapes such as sinks, lavatories and soap dishes have been made available by primary manufacturers of solid surfacing materials in a few of the most popular colors and styles, for the most part the material is only produced in 30 inch by 12 feet sheets and in ¼ inch, ½ inch and ¾ inch thickness. The widest selection of style and color is available in ½ inch thickness with ¼ inch thickness being the next most available.

Plastic solid surfacing materials are available from several U. S. manufacturers such as E. I. dupont de Nemours & Co., Inc. of Wilmington, Del. 19898 U.S.A., who market their polymer based solid surfacing materials under the trademark of "Corian". "Corian" is a substantially rigid, non-foamed, non-laminated, non-coated solid material composed primarily of acrylic components. "Corian" is most often made and sold in sheet form. U.S. Pat. No. 3,847,865 issued Nov. 12, 1974 to R. B. Duggins and assigned to E. I. dupont de Nemours & Co., teaches one formula for making plastic solid surfacing material of the general nature of that referred to in this description.

Another manufacturer of polymer based solid surfacing material is the Nevamar Corporation located at 8339 Telegraph Rd., Odenton, Md. 21113 U.S.A. The Nevamar Corporation markets their solid surfacing material under the trademark of "Fountainhead". "Fountainhead" is a substantially rigid, non-foamed, non-laminated, non-coated solid material composed of a polymer alloy comprised mostly of polyester components having therein a smaller percentage of acrylic components. "Fountainhead" is most often made and sold in sheet form.

Another manufacturer of polymer based solid surfacing material is the Formica Corporation, located at 155-T Rte. 46, W., CN-980, Wayne, J. J. 07470 U.S.A. The Formica Corporation sells their solid surfacing material under the trademark name of "Surell" "Surell," like "Corian" and "Fountainhead," is a dense solid plastic most often made and sold in sheet form. "Surell" is a substantially rigid, non-foamed, non-laminated, non-coated solid material composed substantially of polyester components.

Du Pont, the Nevamar Corporation, and the Formica Corporation, and several other companies not specifically mentioned, who produce polymer based solid surfacing materials similar to one another, manufacture and sell polymer based solid surfacing materials in sheet form intended for use as walling or countertops, and sometimes make and sell cast or heat-formed shapes made of the same polymer based materials useful as kitchen and bathroom lavatories.

Some of the recognized advantages of using polymer based solid surfacing materials such as "Corian", "Fountainhead" or "Surell" over the available materials such as wood, metal, ceramic tile, and high pressure plastic laminates exists in the fact that the material is a solid, polymeric non-laminated structure in which the color or decorative color patterns extend completely therethrough. If polymer based solid surfacing material does become stained, burned or scratched so deeply that the damage cannot be removed with a common household abrasive cleanser, the damage can be easily removed by light sanding with steel wool or fine sandpaper, and this due to the fact that the material is solid, and the color or visual patterns extend completely therethrough. Furthermore, plastic solid surfacing materials typically have a high tensile strength, are quite hard, dense and rigid, and are resistant to chipping, cracking, splitting, warping, burning, and staining, all of which cannot be said about many other materials which could be used as substitutes therefor.

Another attractive quality associated with polymer based solid surfacing materials such as those sold under the trade names of "Corian" "Surell" or "Fountainhead" is the ease of adhesive bonding with available colored glues. Additionally, the polymer based sheets can be easily cut to size or otherwise shaped with mechanical material removal methods and tools using sawing and shaping tools such as router bits, power saws and shapers and the like, similar to those used to cut and shape wood.

Polymer based solid surfacing materials such as "Corian" "Surell" or "Fountainhead" may be manufactured at a relatively low price to very closely resemble texture and visually simulate marble, granite, and other natural stone products which have long been desired and used as building materials due to recognition of the durability and beauty of such natural substances.

Due to the significant number of available colors and patterns of solid surfacing material in sheet form, there is a growing demand for larger and more complex architectural units having floor to ceiling walls and wall corners. Moreover, owners increasingly request that the corners be coved and rounded to facilitate sanitation and to appear as if carved and polished from a single monolith i.e. completely seamless.

Prior art methods for fabricating coved inside corners normally include the bonding of a filler strip along the corner and subsequently routing a radius into the filler strip. This method, however, produces a long, feather edge of the filler strip running into an adhesive layer in the plane of the adjacent wall. This process involves utilizing a specialized jig or tool guide for holding the router at a forty-five degree angle to cut the radius. There is little room for error with this procedure, since routing the cover too deep would cut into the wall, and too shallow a cove would require extensive sanding. The installer, therefore, must be highly skilled in this procedure. In addition, the procedure is time consuming, and is, therefore, relatively expensive.

U.S. Pat. No. 5,330,262 to C. R. Peters describes a method of fabricating a coved, countertop backsplash from solid surfacing material wherein the cover fillet seams intersect the respective counter surface planes at substantially 90°. Unfortunately, the Peters method is preferably a shop practiced method that is difficult to carry-out on the field job site of an in situ construction.

It is an object of the present invention, therefore, to teach a method of fabricating radiused inside comer walls with solid surfacing material that is suitable for field practice and assembly.

Another object of the present invention is to provide special shapes and moldings formed from solid surfacing material sheet stock that facilitate seamless joints.

A still further object of the present invention is to provide jigs, clamps and a corresponding assembly method by which a large architectural enclosure such as a bath or shower stall may be fabricated entirely of solid surfacing material without seams or abrupt planar intersections.

SUMMARY OF THE INVENTION

These and other objects of the invention are accomplished by a solid surfacing material construction method having special moldings for transitional shapes that are partially self aligning. Such moldings are shop milled from stock sheets of solid surfacing material to include rabbet channels along butt joint edges. These rabbet channels are oriented angularly to receive a wall sheeting edge with a radiused cove about the transition. A clamping system is secured to the finish face of the wall sheet and molding by hot-melt adhesive and aligned to draw the back, inside comer of the molding rabbet channel against the back, outside comer of the joined wall sheet.

Preparatory to a field assembly, the edge of one wall of an intersecting pair of walls is joined to the respective comer molding piece that is to transition between the two intersecting walls. This joint is secured in a table fixture for a substantially perfect seam line that is 90° to the surface plane. This seam line will subsequently be sanded and polished to obscurity.

With the comer molding secured to and finished with one wall of solid surfacing material, the prefabricated wall unit is aligned with and secured to the structural supporting frame.

The cooperatively intersecting wall unit is aligned with its respective structural. wall and the other rabbet channel in the molding edge. Surface adhered clamps draw the respective adhesive coated inside comer of the molding rabbet against the outside comer of the wall edge to fill and secure the seam.

BRIEF DESCRIPTION OF THE DRAWINGS

The present invention may be further understood by reference to the following description and attached drawings which illustrate the preferred invention embodiments and wherein.

DESCRIPTION OF THE PREFERRED EMBODIMENTS

Figure 1:
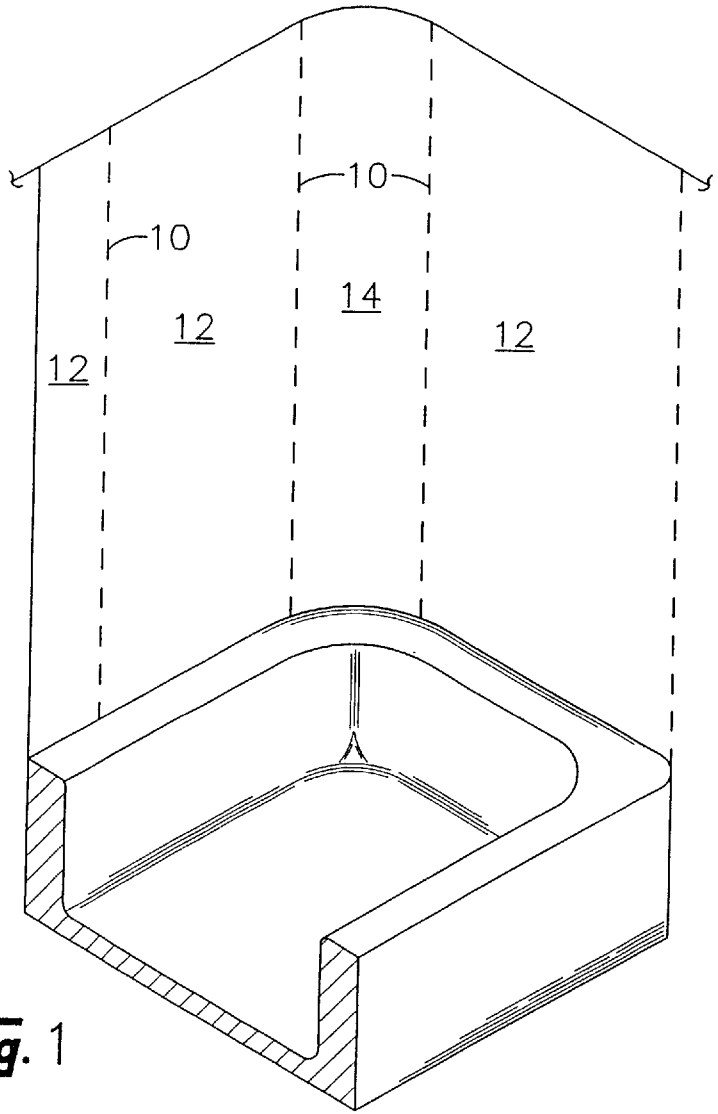
FIG. 1 is a partial isometric of a bath tub enclosure.

As a representative application of the present invention, FIG. 1 partially illustrates a bathtub alcove having a 90° coved inside wall corner. Dashed lines 10 on the drawing represent the approximate locations of edge joints between adjacent units of solid surfacing material (SSM). In this case, a shop fabricated 90° cove molding 14 is edge jointed to adjacent factory formed planar wall sheets 12. Factory sheets are normally formed to 30 inch×12 ft. planar perimeter dimensions and ¼ inch, ½ inch and ¾ inch thickness dimensions. Wall sheathing applications, as illustrated by this example, are usually served by a sheet that is ¼ inch thick, 30 inches wide and 98 inches long.

Figure 2:
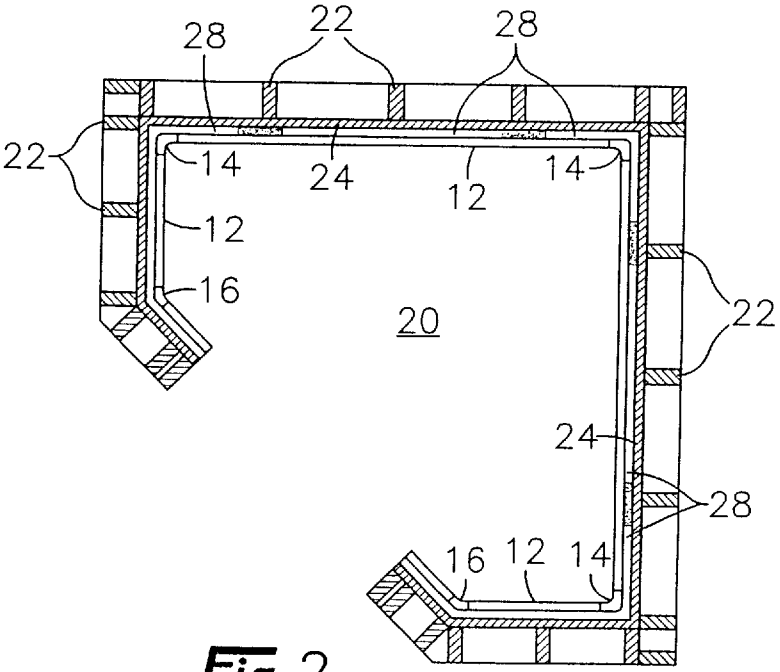
FIG. 2 is a plan view of a bathroom interior construction.
Figure 3:
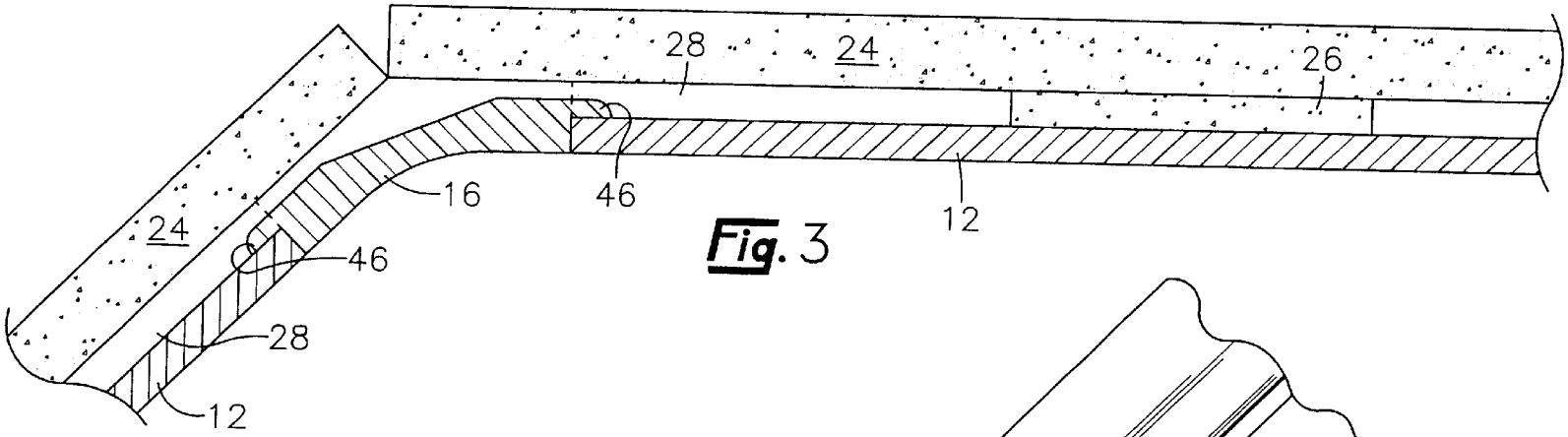
FIG. 3 is a sectioned view of a shower wall along a 45° coved corner.

FIG. 2 is an architectural plan of a shower enclosure 20 defined by structural stud walls 22. Inside edges of the studs 22 are sheathed by a moisture resistant wall board 24 which is secured to the stud edges by nails, screws or adhesive. Typically, such wall board is about ½ inch thick. Solid surfacing material (SSM) assembly components comprising wall sheets 12, 90° cove moldings 14 and 45° cove moldings 16 are adhesively attached to the moisture resistant wall board by structural foam strips 26, as illustrated by the enlarged detail. of FIG. 3, to provide vertical air circulation and expansion spaces 28 between the inside surfaces of the solid surfacing material and the outside surfaces of the wall board 24. These polymer sheet strips 26 are usually about¼ inch thick and are secured initially to the SSM backside by silicon adhesive.

Joints between adjacent SSM components are secured by color coordinated adhesive. Contiguous edges of adjacent components close to a gap error of preferably no more than 1/64 inch. Excess adhesive squeezed from the joint when assembled is, when cured, milled flush to the SSM face and polished with a finishing abrasive. SSM joints fabricated according to this procedure, known to the trade as a "hardseam", are imperceptible to casual inspection and touch. The entire assembly produces the appearance of being materially integral.

The manual effort required to produce such a tactily imperceptible hardseam is greatly reduced by applying a strip of masking tape across the outside surface of the dry outside surface of the assembled joint prior to adhesive application. While assembled dry, the strip of tape bridging the joint is cut with a sharp, thin knife point along the joint. The tape remains on the SSM surface when the joint is assembled with adhesive. As the joined pieces are pulled together and excess adhesive is extruded from the seam, the extruded excess substantially lays over onto the masking tape. After the tape is set but prior to complete cure, the tape is stripped away to carry the excess adhesive bead with it.

For the purpose of nomenclature definition, those surfaces of an architectural unit that are constructed to be visually exposed when finished are herein described as "outside" surfaces. The term "architectural unit" is to be interpreted expansively to mean enclosures such as shower stalls, bath tub alcoves, entire rooms, halls, passageways, cabinetry and furniture.

Figure 12:
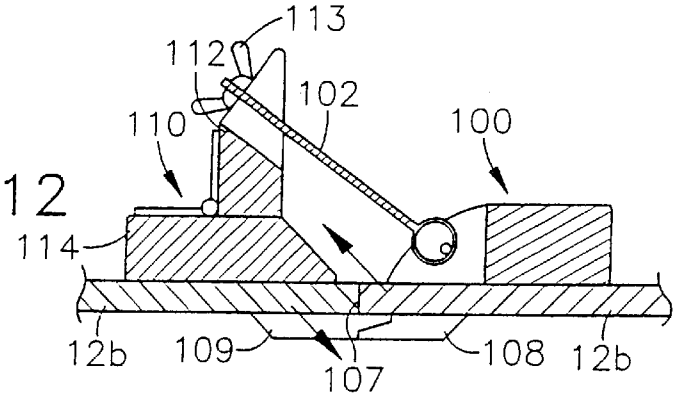

Among the several steps essential to the successful construction of such a large, completely hardseamed SSM enclosure as a shower or bath alcove is an accurate milling of the 90° and 45° comer cove moldings 14 and 16, respectively. Referring to FIG. 12, a cross-section of a 90° cove molding 14 is shown to be formed within the ½ inch thickness t of a standard SSM sheet 11 between opposite surface planes 17 and 19. Although a wide latitude of design discretion is available, one combination of dimensions includes a 1–¼ inch cove radius r, turned about an 89° arc a and about 1–⅝ inch chord $C_1$. The remaining minimum web thickness $W_1$ at the greatest depth of the cove arc is about ¼ to 3/16 inch or the approximate thickness of a ¼ inch wall sheet. At opposite ends of the arc chord $C_1$ are rabbet channels 30, each having a longitudinal edge surface 32 and a lap surface 34. A rabbet channel 30 is formed by the 90° stepped intersection of the planes respective to the edge and lap surfaces.

The rabbet channel 30 depth, which corresponds to the edge surface 32 width, is about ¼ inch or substantially the same as the SSM sheet it is to be joined with. The lap surface 34 width is substantially the same as the edge surface. The lap plate 36 is preferably accorded a material thickness of about 3/32 inch to allow an approximately 5/32 inch expansion space between the wall board 24 and the lap plate 36 backside. See FIG. 3.

Figures 26, 27:
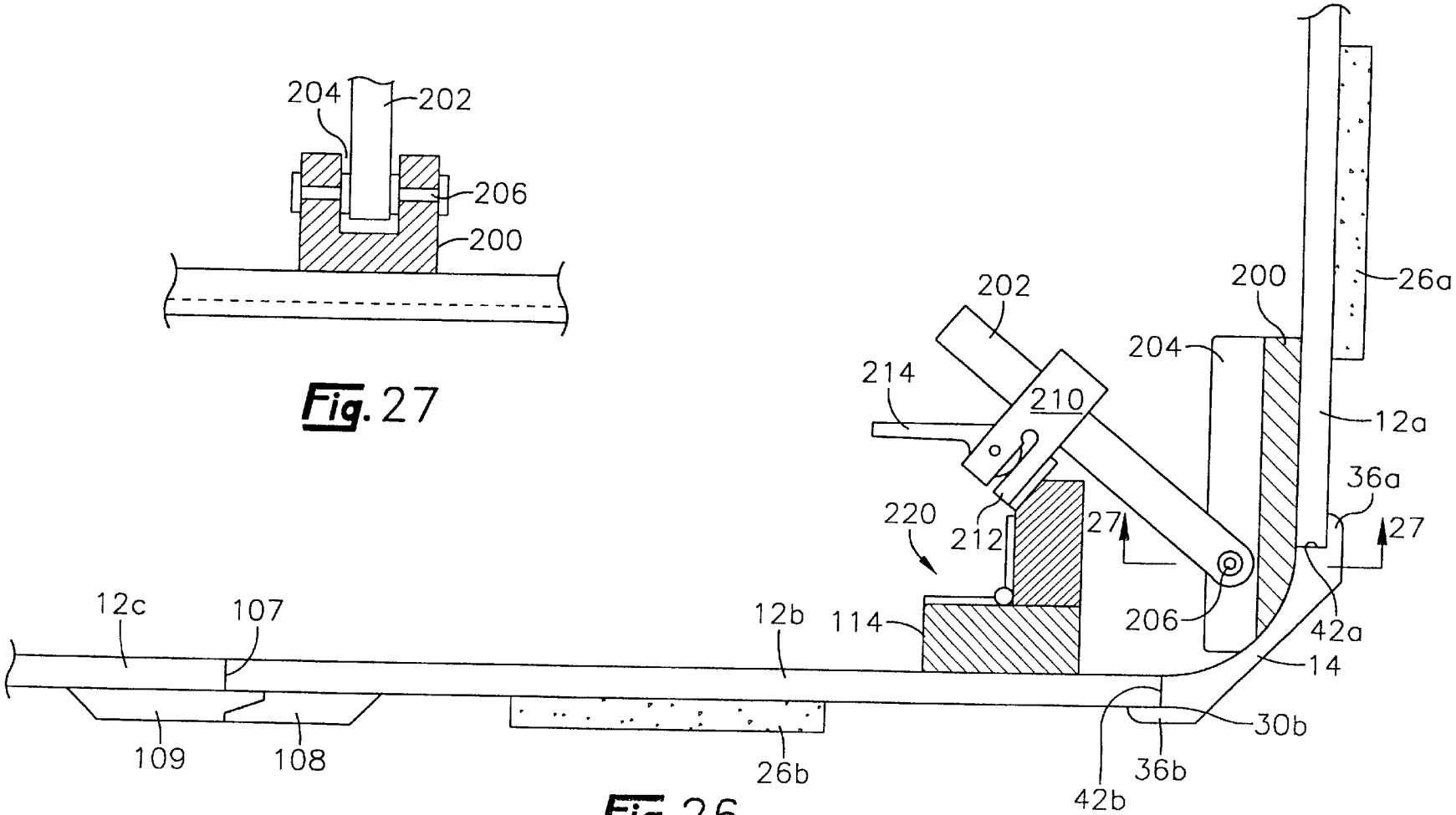
FIG. 26 a cross-sectional view of an alternative embodiment for the final assembly jig.
FIG. 27 is a cross-sectional view of the bar clamp mounting shoe for the alternate embodiment illustrated by FIG. 26 along the cutting plane 27—27.

Although necessitating additional assembly steps, the FIG. 27 invention embodiment illustrates a molding strip 240 having fabricated rabbet channels 242 that are formed by lap plates 244. The lap plates may be bonded to either the molding strip 240 or to the respective wall sheets 12*a* or 12*b*.

Figure 13:
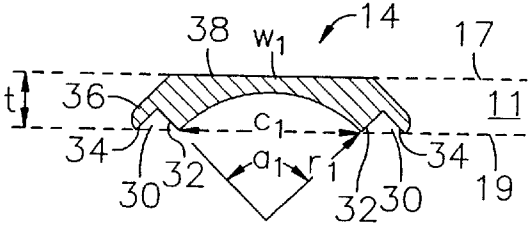
FIG. 13 s a cross-sectioned fabrication detail of a 90° long radius cove molding.

FIG. 13 illustrates the construction details of a 45° molding strip that also is milled from a ½ inch SSM sheet thickness. In this case, the arc $A_2$ is cut to 44°: one degree less than the installation arc of 45°. A chord $C_2$ of 2 inches will provide a central web thickness $W_2$ of about ¼ to 3/16 inch. The arc $A_2$ is delineated by rabbet channels 40. The rabbet lap plate 46 is about 3/32 inch thick to allow an approximate 5/32 inch expansion space between the wall board 24 and the lap plate 46 back side. See FIG. 3.

Figure 4:
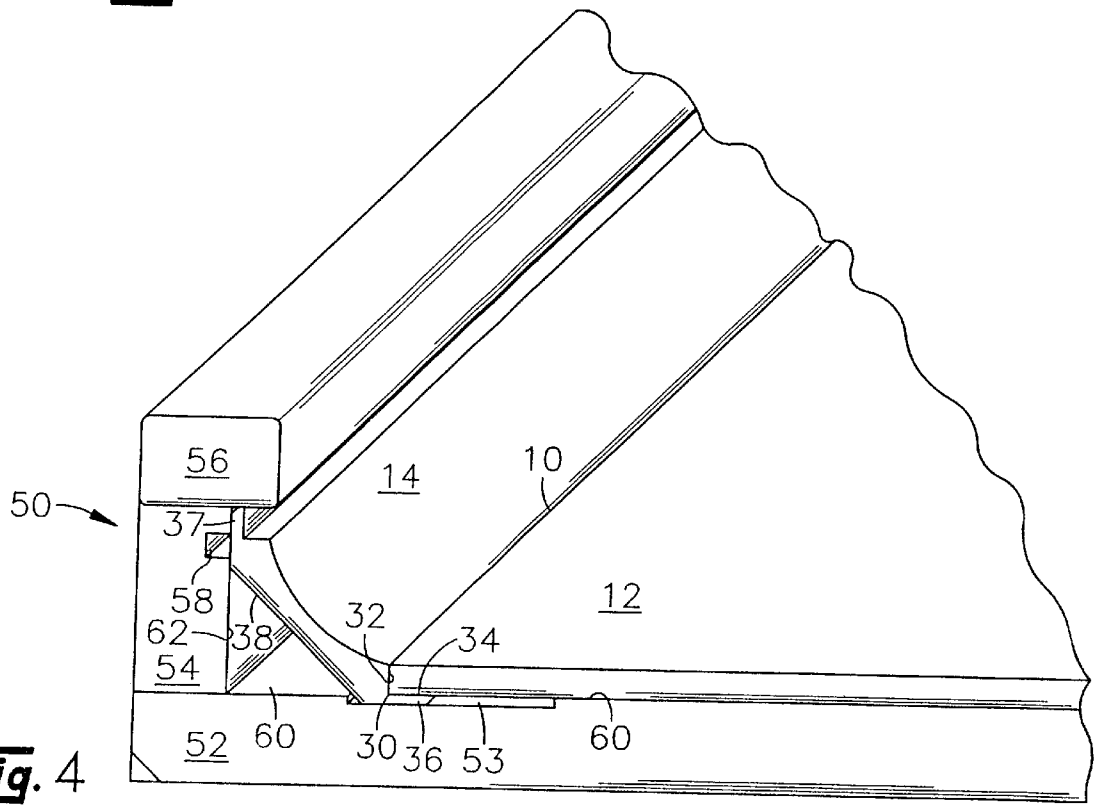
FIG. 4 isometrically illustrates a 90° long radius coved comer subassembly jig.
Figure 5:
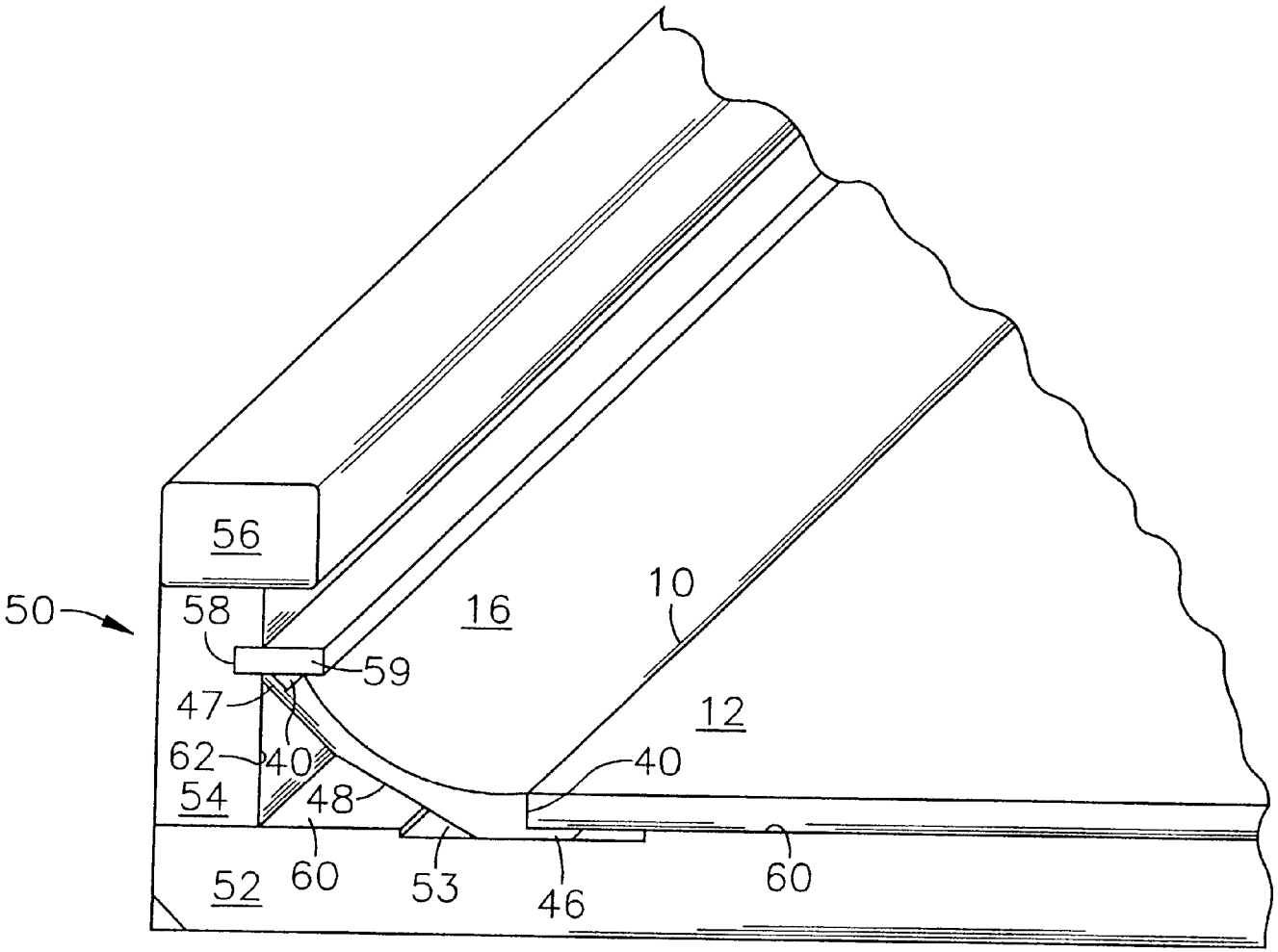
FIG. 5 isometrically illustrates a 45° long radius coved comer subassembly jig.

Although relatively large architectural units such as shower and bath alcoves require an in situ final assembly, it is strongly preferred that corner cove moldings be jig assembled to one adjacent wall sheet prior to final installation as is shown by FIGS. 4 and 5. The 90° cove molding assembly jig 50 of FIG. 4 is the same jig 50 of FIG. 5 for assembling 45° cove-molding with an accessory strip 59. Basic construction of the cove molding assembly jig comprises a base plate 52 and a pair of abutment fences 54 and 56. The first fence is hereafter characterized as a base fencing block 54. The second fence is hereafter characterized as a cap fencing block 56.

The base plate 52 includes a depressed surface channel 53 of depth below the base plate top surface 60 corresponding to the thickness of the 90° molding 14 lap plate 36 whereby the lap surface 34 is coplanar with the base plate top surface 60 when the extremity of the opposite molding lap plate 37 is in contact with the underside of the cap fencing block 56. It should be noted that the molding backside reference surface 38 is set at 45° to the base plate 52 top surface plane and the inside surface plane 62 of the base fencing block 54.

The wall panel 12 to be joined with the cove molding 14 is prepared by securing a line of clamping blocks 70 along the wall panel edge at 4 to 6 inch spacings. These blocks 70 are secured rapidly with a minimum volume of hot melt adhesive. Although the clamping blocks 70 are glued to the outside surface of the SSM and therefore will become a finished face of the wall, these blocks are quickly and cleanly removed by a topical application of denatured alcohol followed by a light rap or shock.

Each clamping block 70 is about 1–½ in.×1–½ in.×2 in. long with a beveled backface 72. The bevel angle of backface 72 is set with consideration of the assembly jig 50 dimensions to provide a clampface surface that is substantially parallel with the beveled end face 55 of the jig base plate 52.

So prepared, adhesive is applied to both surfaces 32 and 34 of the molding 14 rabbet channel 30 and the mating edge surfaces of the wall panel 12 and the components positioned in the jig 50 as illustrated. Immediately, while the adhesive remains fluid and workable which is usually 10 to 15 minutes, clamps 80 are applied between the clamping blocks 70 and the base plate end face 55. Although numerous types and styles of clamps may be used, the cam operated sliding bar type of clamp illustrated has numerous advantages including economy and speed of operation. Such a clamp comprises a bar or beam 82 having an anvil dog 84 and a sliding dog 86. The anvil dog 84 is rigidly secured to the bar 82 as by pins 85.

The sliding dog 86 includes a slot 87 to slidably receive the bar 82 with sufficient clearance to "wedge" into the bar 82 when sufficient torque is applied to the distal end 87 of the sliding dog 86. The sliding dog distal end 87 is split by a kerf 88 to provide a rigid base 90 and a mandible 92 that swings about a hinge section 94. A slot 96 confines a lever engaged cam 98 for rotation about a pin 97. When the lever 98 is rotated about the pin 97, the inside cam face not shown bears against the mandible 92 to load the clamp jaw face 93 into the block 70 and press the lower corner of the wall sheet 12 into the inside corner of the 90° molding 14 rabbet channel 30 for the interval required to set the adhesive.

When the adhesive has substantially cured, a bead of hardened adhesive that was extruded from the joint line 10 is router trimmed flush with the interior surfaces of the SSM cove 14 and panel 12. Alternatively, the previously applied masking tape is stripped from the joint flanking forces when the adhesive is set but not completely cured. The remaining ridge of adhesive is sanded away by 300 to 600 grit abrasive paper to a degree of tactile imperceptability. If correctly prepared and positioned, the width of this joint line 10 is less than 1/64 inch wide along its entire length and completely filled with adhesive material. Unless the panel 12 and cove 14 core are of visually contrasting color or texture SSM composition, the joint line 10 may be made virtually invisible.

Referring to FIG. 5, it is to be noted that the dado channel 58 in the fencing block 54 is filled with the 45° accessory strip 59 to provide a dimensionally controlled abutment surface for the distal edge of one 45° molding lap plate 47. The other molding lap plate 46 is disposed along the base plate surface channel 53. The molding backside reference surface 48 is aligned at 22.5° to the base plate 52 top surface plane 60. In this alignment, adhesive is applied to the rabbet channel 40 and the adjoining edge of SSM wall panel 12 is positioned along joint line 10 and clamped as previously described with respect to the 90° molding jig procedure of FIG. 4.

Figure 6:
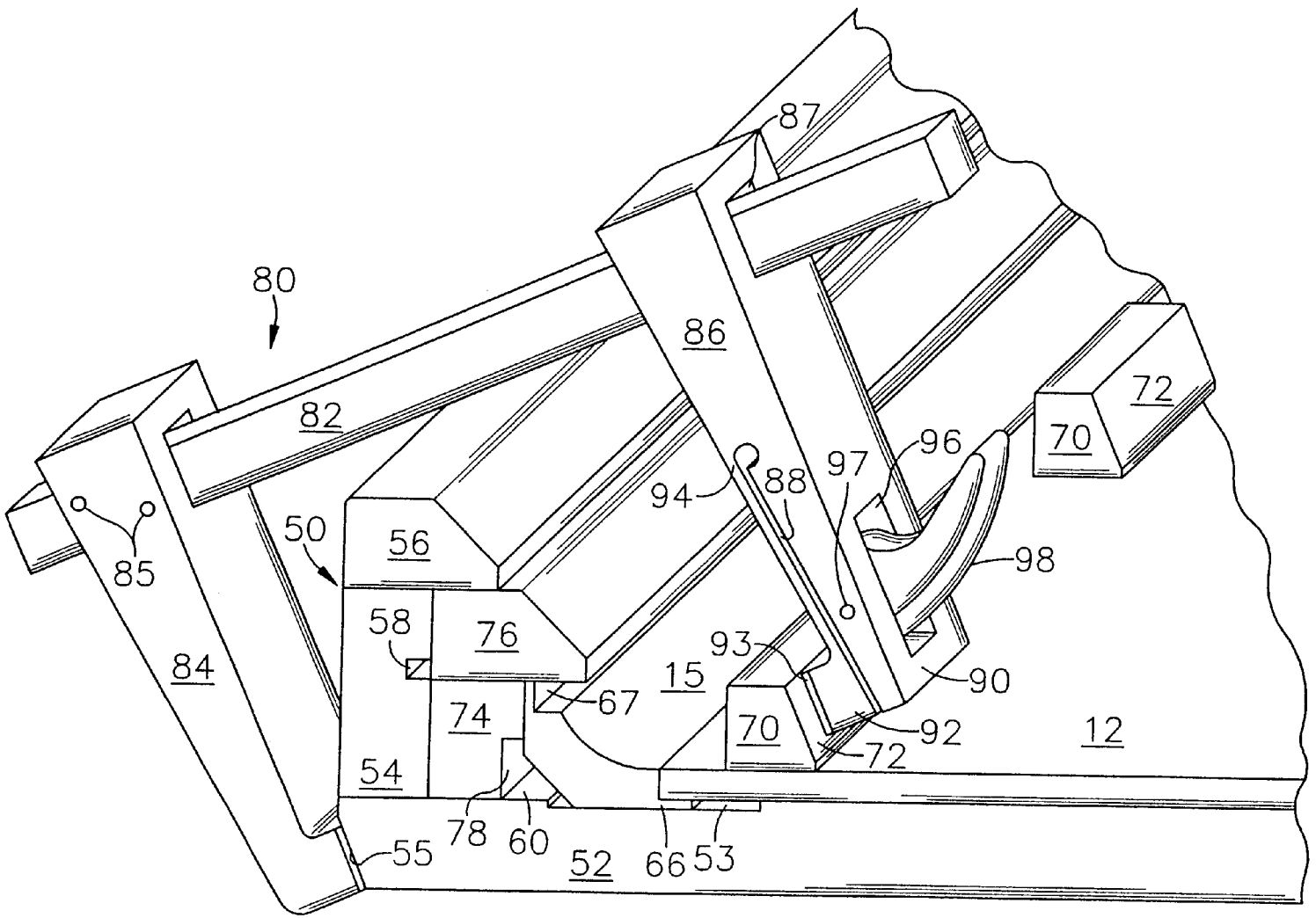
FIG. 6 isometrically illustrates a 90° short radius coved comer subassembly jig.

Referring now to FIG. 6, the same assembly jig 50 is again modified to join a short radius 90° cove molding 15 to a SSM wall panel 12. The lap plates 66 and 67 remain the same dimensionally as the lap plates 36 and 37 of the long radius cove molding 14. However, the chord distance between the lap plate ends is considerably less due to a smaller cove radius $r_1$. Correspondingly, the backside reference surface 68 is more narrow than backside 38. In accommodation of these dimensional differences, an auxiliary base fence block 74 and an auxiliary cap fence block 76 are provided to fit within and fill the dimension between the top surface 60 of the jig base plate 52 and the underside of the cap fence block 56. The overhanging bottom ledge surface 77 of auxiliary cap fence block 76 and the face of auxiliary base fence block 74 serve the lap plate abutment function to confine the short radius molding 15 against the thrust of clamps 80.

Auxiliary base fence block 74 is further modified with a rabbet channel 78 to receive the lap plate of a 45° short radius cove molding not shown but in the same manner as FIG. 5.

Figure 25:
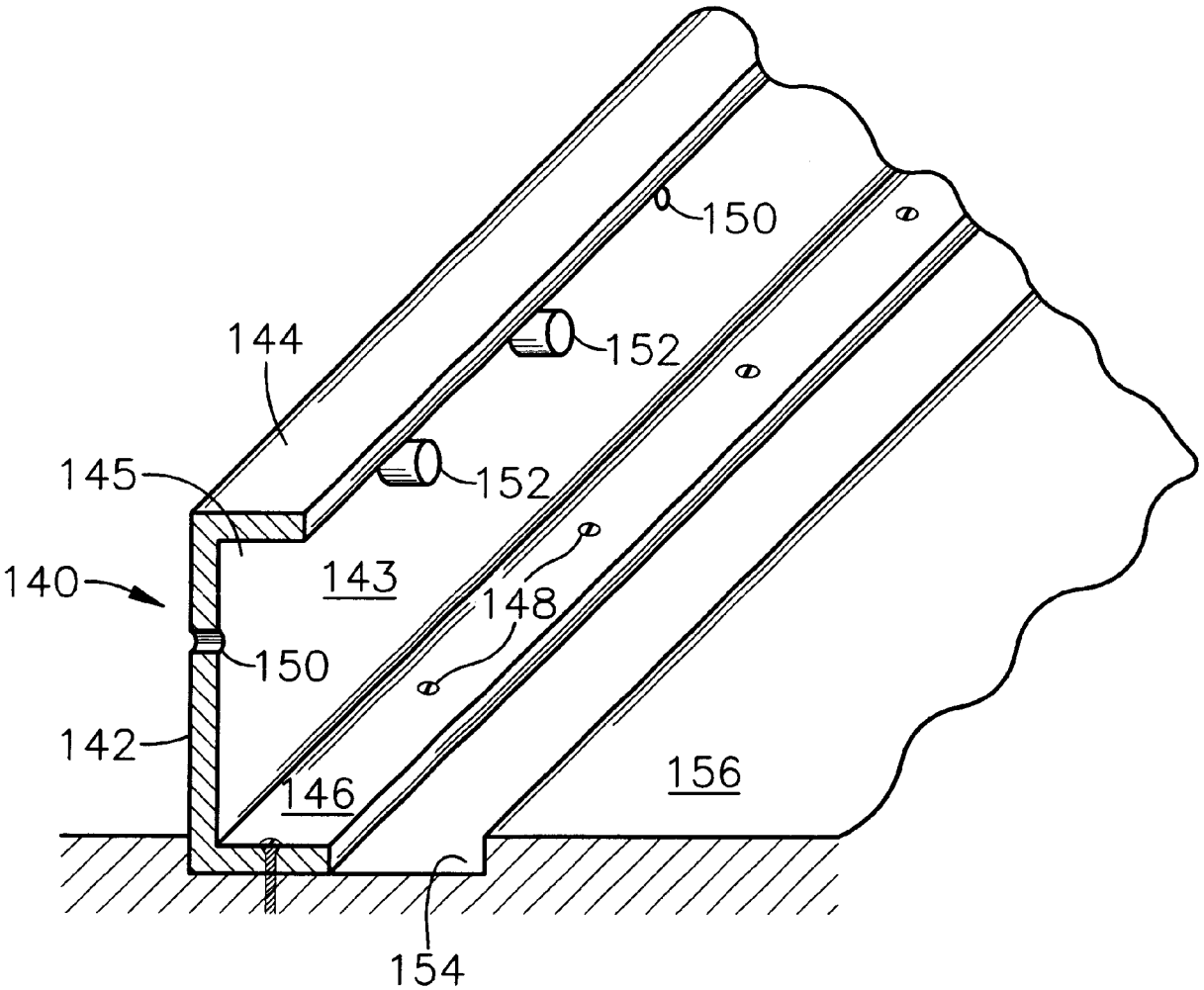
FIG. 25 illustrates an alternative coved corner jig assembly.

An alternative molding attachment jig 140 is illustrated by FIG. 25 as fabricated from a metal channel section 142 having a fence structure or abutment fence 143 with a cap flange 144 and a base flange 146 integrally formed at opposed edges of the abutment fence 143. The base flange is set in a dadoed channel 154 and secured by screws 148 with the abutment fence 143 standing upright, as shown. The comer of the abutment fence 143 and the cap flange 144 forms an edge abutment pocket 145. The depth of dado channel 154 below a supporting table top surface 156 corresponds to the molding lap plate 46 thickness. In lieu of a dado channel 154 into the surface of a work table, the same objective may be obtained by attachment of the channel base flange 146 directly to the table surface in combination with a spacer sheet of lap plate thickness under the SSM sheet to be adhesively attached to the molding piece in the jig 140.

To reconfigure the alternative jig 140 to join a 45° molding with a sheet of SSM, it is only necessary to insert dowel pins 152 into the apertures 150 formed in the abutment fence 143 of the channel section 142 to provide a structural abutment line corresponding to an accessary strip.

When either or both wall planes of an enclosure are out of "plumb" with respect to a horizontal floor or ceiling plane, the departure from plumb must be measured and accommodated. As an expedient to such measurement, a length of cove molding appropriate for the subject corner, whether 90°, 45° or other, without the lap plates 36 and 37 but with shims to fill the air expansion space 28 between the molding backside and the wall board 24, the location of the vertical edges 42*a* and 42*b* of the wall panel sheets are marked on the adjacent wall board 24. This may be done with a short length of modified cove molding used as a gauge at the top and bottom of the wall with the markings linked by a straight line. The resulting line between the top and bottom gauge marks may not be perpendicular to the floor and ceiling, assuming that is desired. In any case, any taper in either of these lines must be transferred to the vertical edges 42*a* and 42*b* of the respective wall panels 12*a* and 12*b*.

Figure 7:
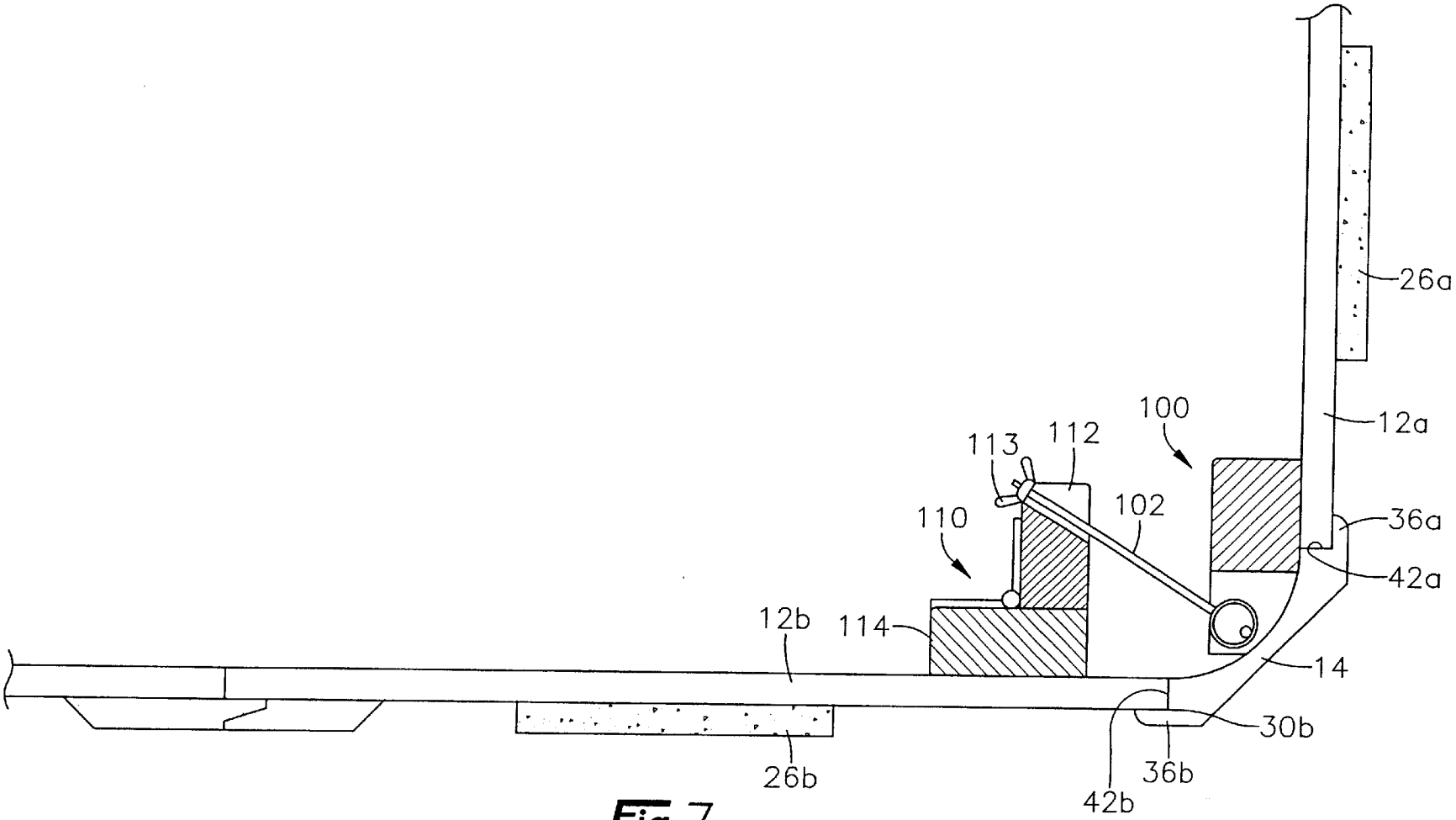
FIGS. 7–12 orthographically illustrate in vertical cross-section respective arrangements of the final assembly jig.

With respect to FIG. 7, a unitized assembly comprising an SSM cove piece 14 and SSM wall panel 12*a* is aligned on the intended wall structure with the mating SSM wall panel 12*b*. The unitized SSM assembly, including the polymer foam strips 26*a*, is permanently secured by silicon adhesive, for example, to the adjacent wall board 24. The silicone adhesive allows 10 to 15 minutes of working time before setting. With the unitized assembly of panel 12*a* and cove molding 14 securely in place, the mating edge 42*b* of the SSM wall panel 12*b* is marked with the measured taper and cut to a 1/64 in. fit with the molding rabbet channel 30*b*. Next, a shoe block 100 is secured to the outside surface of the unitized assembly by a hot melt adhesive in the same manner as clamping blocks 70 were secured. A cooperative base block assembly 110 is similarly secured along the edge 42*b* and outside face of the unattached wall panel 12*b*. The foam strips 26*b* are adhesively applied to the backside of the panel.

A silicone adhesive is applied to the inside surfaces of the foam strips 26*b* and the panel 12*b* is positioned on the wall with the edge 42*b* aligned to the rabbet channel 30*b* of the cove molding 14. The alignment is initially made "dry", meaning that no SSM adhesive is on either of the joint surfaces. When the alignment of edge 42*b* in channel 30*b* is of acceptable quality, the silicone adhesive is allowed to complete the setting interval.

With both wall panels 12*a* and 12*b* securely positioned, the cove molding edge of the unitized assembly may be manually deflected against the wall board 24 to expose the edge 42*b* of the panel 12*b*. So exposed, SSM adhesive is applied to the appropriate surface portions and the joint permitted to close. The multiplicity of eye bolts 102 anchored by a pin 104 to the shoe block 100 are positioned to bear against a folding anchor plate 112 and by resulting tensile force, secure the two SSM wall elements along the adhesive coated rabbet channel 30 compression juncture.

Figure 22:
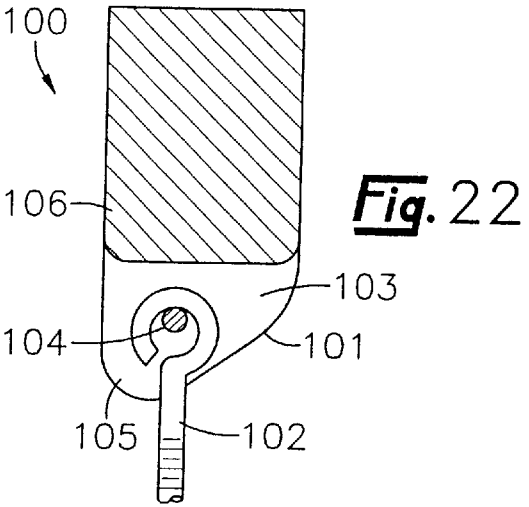
FIG. 22 is a cross-section of a final assembly jig shoe block.
Figure 21:
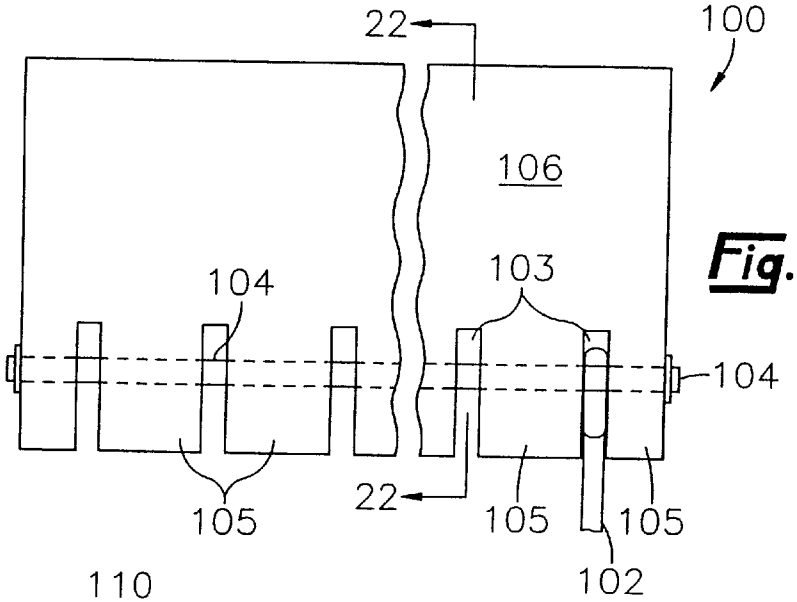
FIG. 21 is a top plan view of a final assembly jig shoe block.

Referring to FIGS. 21 and 22, a shoe block 100 is seen to comprise an elongated rectangular base of a suitable material such as a solid hardwood or strip of SSM scrap. Although a shoe block 100 may be as long as a molding element, such continuity is not essential. In most applications, several shoe blocks, each of 2 to 3 feet length, are more conveniently handled and positioned. One elongated comer of the block is shaped to a convenient curvature 101. For example, a curvature of equal or less radius than the short radius cove of molding 15.

At uniformly spaced increments along the length of the shoe block, slots 103 traversing the block depth from a top face 106 to the base of curvature 101 are cut at uniform increments of, for example, 3 to 6 inches. Fingers 105 of block structure between the slots 103 accommodate a longitudinal bore in receipt of the eye bolt 102 retaining pin 104.

Figure 24:
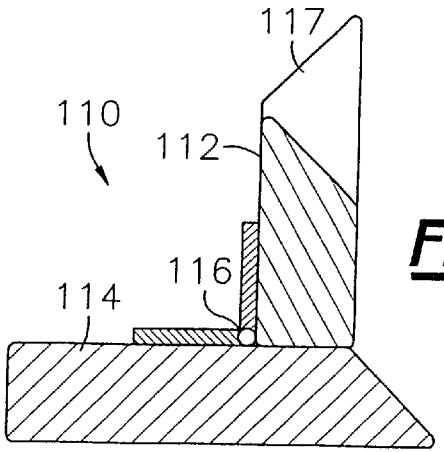
FIG. 24 is a cross-section of a final assembly jig hinge plate.
Figure 23:
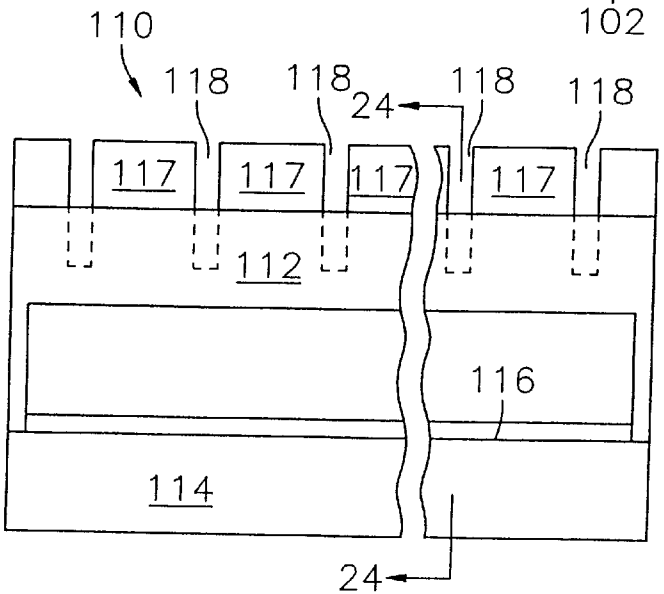
FIG. 23 is a front elevation of a final assembly jig hinge plate.

With respect to FIGS. 23 and 24, the base block assembly 110 is seen to comprise the folding anchor plate 112 and the base plate 114 connected by a hinge 116. Similar to shoe block 100, slots 118 delineate structural fingers 117 of about the same width as fingers 105 on the shoe block.

Figure 11:
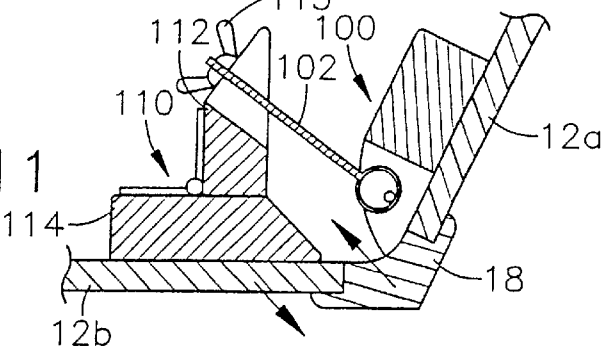
Figure 9:
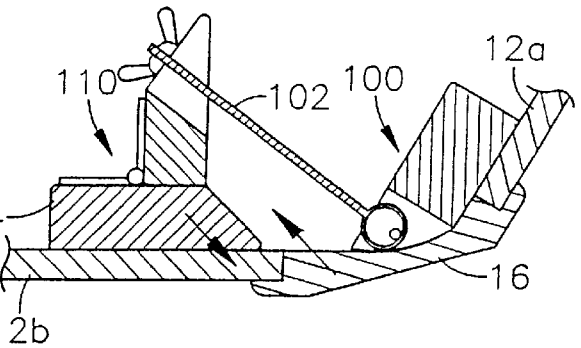
Figure 10:
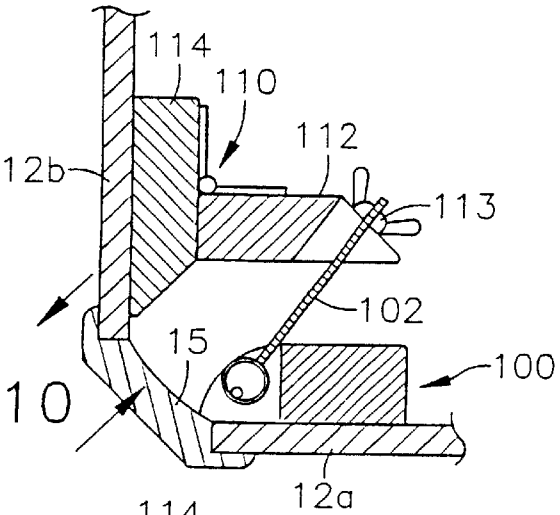
Figure 8:
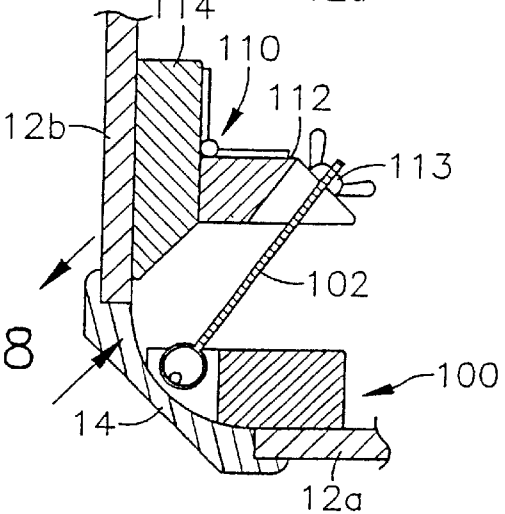

The same jig combination of shoe block 100 and base block 110 is used in several assembly configurations as are represented by FIGS. 8–12. FIG. 8 illustrates the same long radius 90° cove molding assembly as is shown in greater detail by FIG. 7. FIG. 9 illustrates the jig alignment for a long radius 45° cove molding 16. FIG. 10 assembles a short radius 90° cove molding 15 by reversing the shoe block 100 and attaching the shoe block backside 106. Similarly, the reverse turned shoe block 100 backside 106 is also used to assemble the short radius 45° molding 18 as illustrated by FIG. 11. Additionally, FIG. 12 illustrates the reversed shoe block 100 used to secure a butt joint 107 between two wall panels 12*b* and 12*c* in the same plane. In this case, a set of lap fingers 108 and 109 are used to lap the butt joint 107.

As will be noted from FIGS. 8 and 10, some of these assemblies bring the outer surface of shoe block 100 into close proximity with the erected anchor plate 112 of the base block 110. For manual access to the seam line and visual confirmation of the joint quality, it is convenient to fold the anchor plate 112 down against the base plate 114 during the initial joining steps. When the craftsman is satisfied with the joint quality, the anchor plate 112 is raised and the eye bolts 102 laid into the slots 118. The wing nuts 113 are turned on the eye bolt 102 threads into bearing against the fingers 117. In consequence, the joint assembled is subjected to moderately high, uniformly distributed compressive load during the adhesive curing interval for an invisible, razor thin joint line.

FIGS. 26 and 27 illustrate another assembly jig combination having a multiplicity of individual shoe blocks 200 distributed along a joint edge. Each of the shoe blocks 200 has a full length slot 204 for accommodation of a clamp bar 202. One end of the clamp bar 202 is secured to the shoe block 200 by a pivot pin 206. The reach end of the clamp bar 202 accommodates a sliding clamp dog 210 having a mandible 212 engaged by a cam 214. A base block 220 is secured to the outside surface of the SSM wall panel 12*b* by hot melt adhesive as previously described. An anchor plate 222 hinged to the base plate 224 is rotated to a position of convenient engagement by the clamp dog mandible 212.

Figure 28:
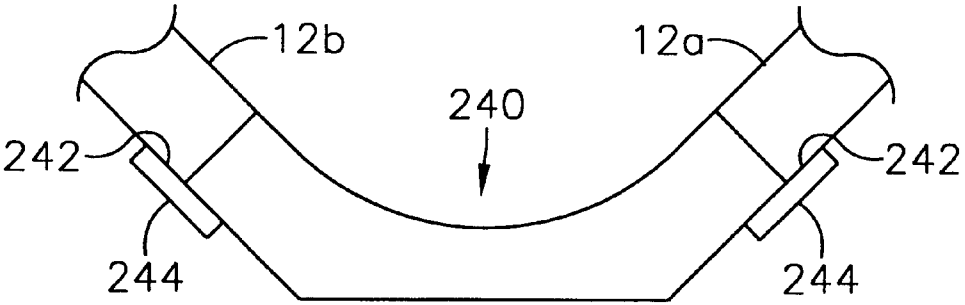
FIG. 28 is a cross-sectional view of an alternative embodiment for the cove molding element for the invention.
Figure 29:
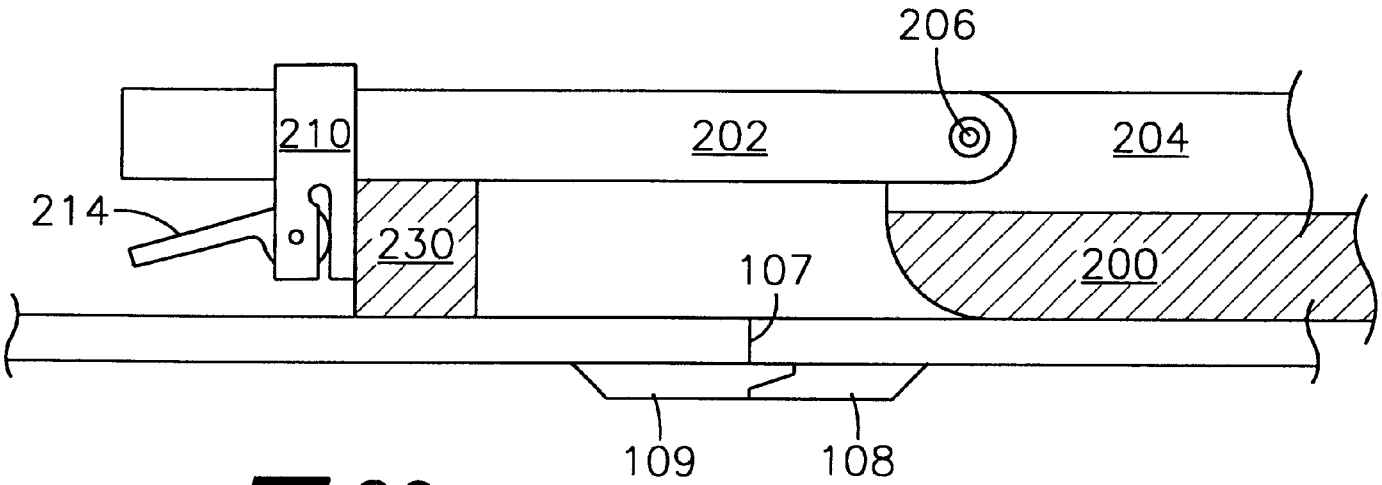
FIG. 29 is a cross-sectional view of an alternate embodiment for the invention.

FIG. 28 illustrates the shoe block 200 jig assembly engaged with a base block 230 to secure a buttjoint 107 between two wall panels 12*b* and 12*c* in the same plane. A pair of lap fingers 108 and 109 lap the butt joint 107.

Figure 17:
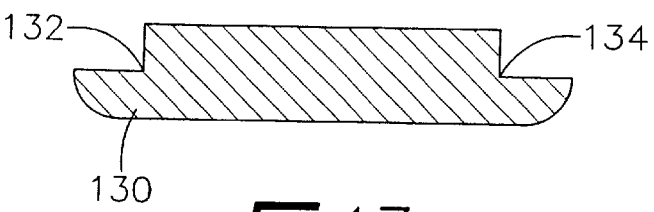
FIG. 17 is a cross-section of a door casement molding.
Figure 16:
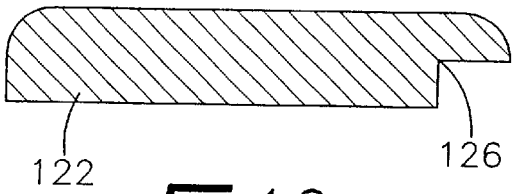
FIG. 16 is a cross-section of a left-hand sill molding.
Figure 15:
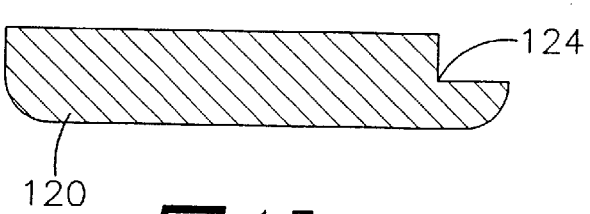
FIG. 15 is a cross-section of a right-hand sill molding.
Figure 14:
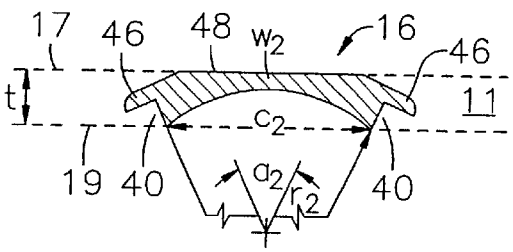
FIG. 14 is a cross-sectioned fabrication detail of a 45° long radius cove molding.
Figure 18:
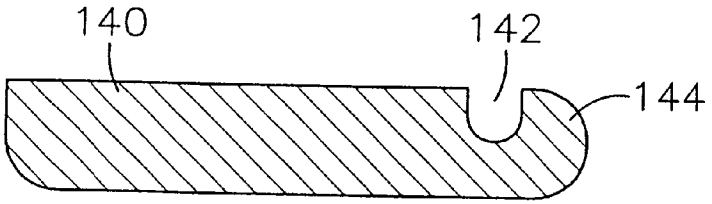
FIG. 18 is a cross-section of a door header molding.

The preferred embodiments of my invention have been described relative to 90° and 45° cove moldings. However, numerous other trim and finish treatments may be fabricated with the same process. FIGS. 15 and 16 respectively illustrate opposite hand turns 120 and 122 of sill molding that joins with a SSM sheet edge along the rabbet channels 124 and 126. FIG. 17 illustrates a typical door casement molding 130 having rabbet channels 132 and 134 respective to opposite wall faces. FIG. 18 illustrates a door header 140 that receives a chamfered SSM sheet edge in the round bottom groove 142 along an offset from the surface edge to produce a lip 144.

Figure 19:
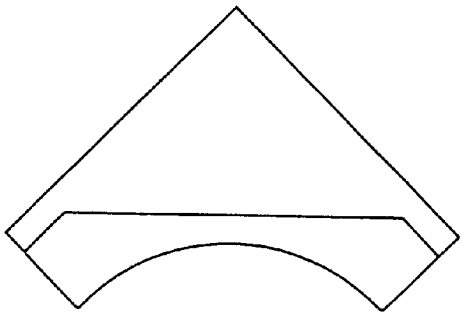
FIG. 19 is a 90° long radius coved cap molding.
Figure 20:
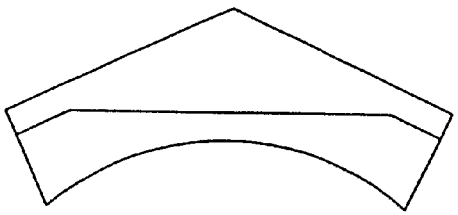
FIG. 20 is a 45° long radius coved cap molding.

FIGS. 19 and 20 illustrate cap moldings respective to 90° and 45° cove molded walls for a finished terminal on a knee-wall or other exposed wall top edge.

While the preferred embodiments of my invention are described above, it will be appreciated by those of ordinary skill in the art that the invention is capable of numerous modifications, rearrangements and substitutions of parts without departing from the spirit and scope of the appended claims.

As my invention, therefore,

I claim:

1. A jig for assembling solid surface material (SSM) cove molding to SSM wall sheets, said cove molding being laterally bounded by longitudinal rabbet channels, having mutually perpendicular abutment edges and lap plates, said jig comprising:

a table surface for supporting an SSM wall sheet with an inside surface in juxtaposition with said table surface and an outside surface of said wall sheet facing away from said table surface;

a depression below said table surface adapted to receive a rabbet channel lap plate of the cove molding beneath an inside surface of said wall sheet;

a fence structure projected from said table surface and substantially rigid therewith; and a fence cap integral with said fence structure and projecting rigidly from said fence structure over said table surface, a comer of said fence structure and fence cap forming an edge abutment pocket whereby an assembly force is adapted to be applied to an outside surface of a sheet supported by said table surface to compress an edge of such sheet into a contiguous rabbet channel abutment edge reacts to trust a lap plate edge respective to the other rabbet channel into said edge abutment pocket.

2. An assembly jig as described by claim 1 further comprising clamping means for application of said assembly force to a sheet outside surface.

3. An assembly jig as described by claim 2 wherein said clamping means includes a clamp abutment block adapted for adhesive attachment to said sheet outside surface.

4. An assembly jig as described by claim 3 wherein said clamping means spans between said abutment blocks and said fence structure to compress said sheet edge into said contiguous rabbet channel.

* * * * *